United States Patent [19]

Cook

[11] Patent Number: 5,056,387

[45] Date of Patent: Oct. 15, 1991

[54] SCREW-HOLDING SCREWDRIVER

[76] Inventor: Chester L. Cook, 410 Bluebird St., Slidell, La. 70458

[21] Appl. No.: 597,366

[22] Filed: Oct. 15, 1990

Related U.S. Application Data

[63] Continuation-in-part of Ser. No. 392,458, Aug. 11, 1989, abandoned.

[51] Int. Cl.[5] ..... B25B 23/08

[52] U.S. Cl. ..... 81/456; 81/177.2

[58] Field of Search ..... 81/177.2, 177.5, 456, 81/457

[56] References Cited

U.S. PATENT DOCUMENTS

| | | | |
|---|---|---|---|
| 2,756,791 | 7/1956 | Ferrara | 81/456 |
| 3,738,768 | 6/1973 | Kuhn | 87/177.5 X |
| 4,581,962 | 4/1986 | Marbourg | 81/457 X |
| 4,827,812 | 5/1989 | Markovetz | 81/177.5 X |

FOREIGN PATENT DOCUMENTS

| | | | |
|---|---|---|---|
| 435352 | 5/1948 | Italy | 81/456 |
| 83013 | 4/1920 | Switzerland | 81/456 |
| 28448 | 5/1914 | United Kingdom | 81/456 |

*Primary Examiner*—James G. Smith

*Attorney, Agent, or Firm*—Allen A. Dicke, Jr.

[57] ABSTRACT

The screw-holding screwdriver has a sleeve threadedly attached to its shank. A chuck on the end of the sleeve has a slot in the side to receive a screw head and shank. By screwing the sleeve up on the shank, the screwdriver bit engages the screw head and clamps the screw head in the chuck for driving the screw. When partially inserted, the sleeve is rotated on the shank to release the screw to permit removal of the chuck from the screw. In this way, the screw is firmly retained while driving.

13 Claims, 3 Drawing Sheets

FIG. 9.
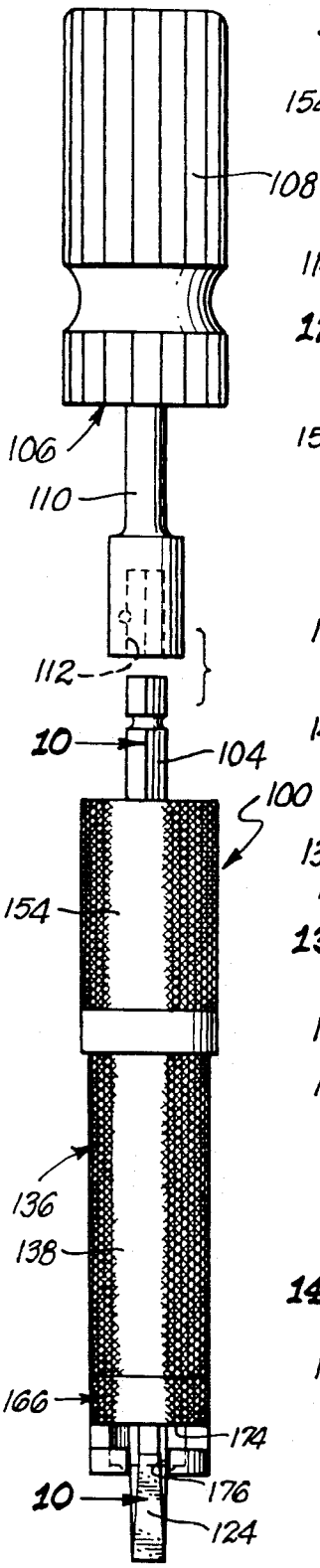
FIG. 10.
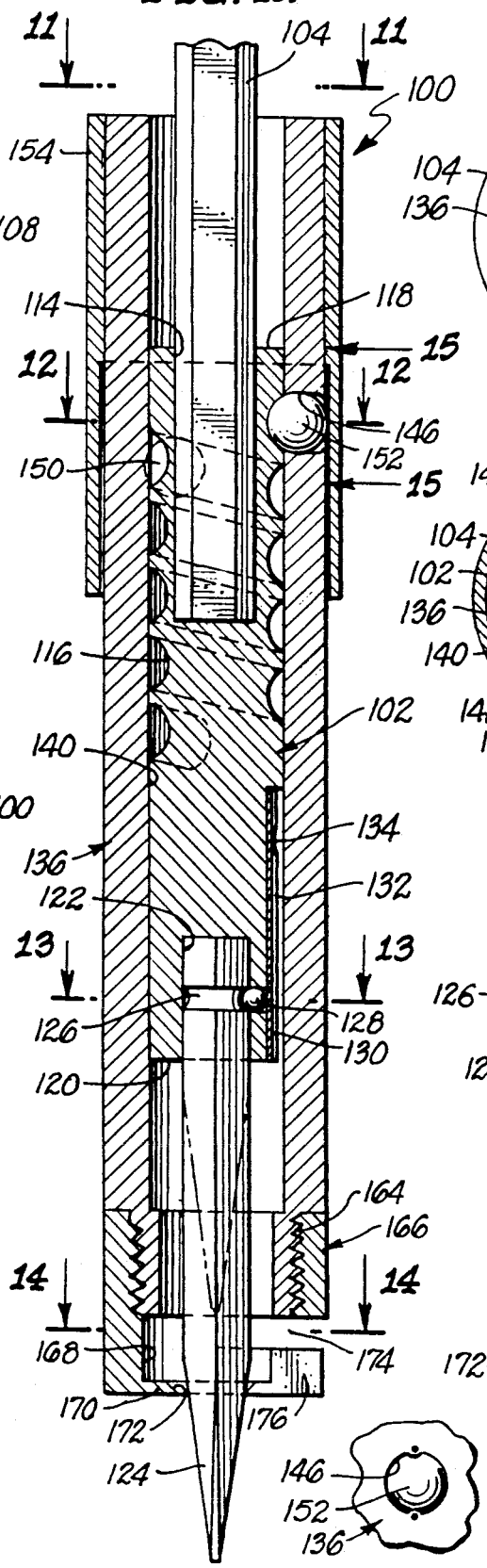
FIG. 11.
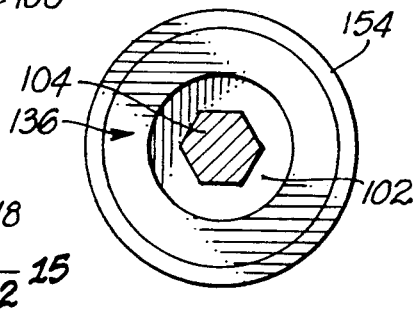
FIG. 12.
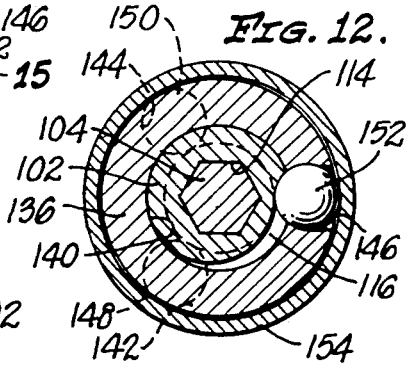
FIG. 13
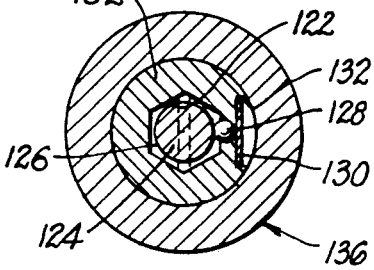
FIG. 14.
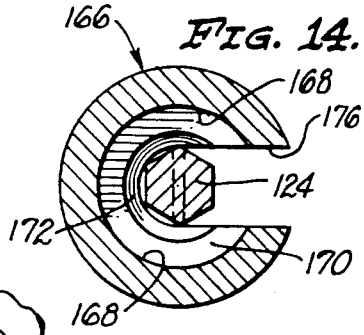
FIG. 15

SCREW-HOLDING SCREWDRIVER

CROSS REFERENCE

This application is a continuation-in-part of my prior application, Ser. No. 07/392,458, filed Aug. 11, 1989 now abandoned for "Screw-Holding Screwdriver", the entire disclosure of which is incorporated herein by this reference.

FIELD OF THE INVENTION

This invention is directed to screwdrivers, and more particularly to screwdrivers of the type provided with means for detachably holding the screw against the screwdriver bit as the screw is driven.

BACKGROUND OF THE INVENTION

Screws are well known fastening means and are fasteners with elongated threaded shanks and a head thereon. The head is shaped so that it may be engaged so that the screw is rotated. The head may have external engagement surfaces such as a hexagonal or a square crown to be engaged by an appropriately socketed driver. The screw head may have interior surfaces thereon to be engaged by a male driver. These surfaces may be a slot, a Phillips recess, a square recess, a hexagonal recess, or other internal driving surfaces These surfaces are engaged by corresponding surfaces on the screwdriver so that the screw is rotated by the driver. In some cases, the screw must be thrust axially along its rotational axis toward the substrate material into which it is being fastened in order to provide for screw thread engagement in the substrate material. This axial force is more often required in inserting wood screws and sheet metal screws, as compared to machine screws.

There have been many kinds of screw-holding screwdrivers on the market, and despite the problems, only minor improvements have been made over the years. The present screw-holding screwdrivers available on the market have many deficiencies, and these deficiencies make them impractical when trying to start a screw into a substrate. Without firmly holding the screw, the screwdriver may cause injury to the user because the bit comes out of the screw and punches the adjacent finger of the user. Such is the result of not firmly holding the screw in place. After such injury, it is clear that an advance in the art was required.

One difficulty in driving a screw into a wood panel or like substrate is getting the point to start into the substrate. It is particularly difficult to initiate engagement of the screw into the substrate on the correct axis without tilting the screw away from the desired line of insertion. This can be mitigated in several ways. One way is by drilling a pilot hole in the substrate. The drilling of pilot holes raises another question because another tool must be brought to the job. In cases of low volume screw insertion, such as the occasional need of a homeowner to insert a screw, the purchase or bringing to the site the drill to create the pilot hole is not justified.

Another way the difficulties in driving a screw can be mitigated is to employ a screw-holding device. Most of the prior art includes a pair of resilient fingers on the screwdriver shank positioned to grasp the screw beneath the head. The fingers are carried on a sleeve which slides on the screwdriver shank and is frictionally retained in position. Such are difficult to use and are not strong enough to apply the considerable axial force necessary to start a screw into the substrate. It is a device which positions the screw, but does not firmly hold the screw while axial force is being applied.

SUMMARY OF THE INVENTION

In order to aid in the understanding of this invention, it can be stated in essentially summary form that it is directed to a screw-holding screwdriver which has a shank, means to rotate the shank about its axis to drive a screw, and a screwdriver bit positioned axially on the shank. A sleeve is threadedly engaged on the shank, and a chuck is mounted on the sleeve. The chuck is configured to receive the head of a screw in a slot in the side thereof so that subsequent rotation of the sleeve on the shank engages the bit in the screw to hold the screw firmly in place on the axis for screw insertion.

It is an object and advantage of this invention to provide a novel, improved and efficient screwdriver constructed to detachably secure a screw to a screwdriver bit with the screwdriver bit engaged in the screw to facilitate driving the screw.

It is another object and advantage of this invention to provide a screw-holding screwdriver which rigidly and securely holds screws in a range of sizes.

It is a further object and advantage of this invention to provide a screw-holding screwdriver which has a sufficiently large sleeve so that it can be grasped during the screw insertion process to add torque to the screw.

It is another object and advantage of this invention to provide a screw-holding screwdriver wherein the screwdriver bit is mounted on a central shank member and a chuck is mounted on a sleeve threadedly engaged with the shank member with the threaded engagement having a quick release so that the chuck may be quickly moved into place for screw engagement.

It is a further object and advantage of this invention to provide a screw-holding screwdriver wherein the bit and/or driver can be of hexagonal configuration to receive standard hexagonal screwdriver bits and bit drivers.

It is a further object and advantage of this invention to provide an extension for the screw-holding screwdriver of this invention so that there is a greater distance between the torque-applying device and the screwdriver bit, but the screw is firmly held in the chuck despite the greater length of the screwdriver with its extension.

It is another object and advantage to provide a screw-holding screwdriver which retains screws by means of a counter-sink so as to permit holding of a range of screws and hold them in proper axial alignment.

It is a further object and advantage to provide a screw-holding screwdriver which permits driving of the screw by employing only one hand so as to permit the other hand to hold the parts and also to permit the other hand to be positioned away from the screw and screwdriver so as to be less likely to hurt the user's fingers.

It is another object and advantage to provide a screw-holding screwdriver which permits the starting and screwing in of larger size screws by employment of a crossbar handle in the regular handle of the screwdriver.

It is a further object and advantage to provide a screw-holding screwdriver which, due to the firm holding of the screw thereon, can be used for starting its own pilot hole by hammering on the handle of the screwdriver when the screw is in place and positioned over its site.

It is a further object and advantage of this invention to provide a screw-holding screwdriver which may be made of expensive materials so that it may be widely used.

Other purposes and advantages of this invention will become apparent from a study of the following portion of the specification, the claims and the attached drawing.

BRIEF DESCRIPTION OF THE DRAWINGS

FIG. 9 is a side-elevational view of the second preferred embodiment of the screw-holding screwdriver of this invention.

FIG. 10 is an enlarged section taken generally along line 10—10 of FIG. 9.

FIG. 11 is a plan view, as seen generally along line 11—11 of FIG. 10.

FIG. 12 is a downwardly looking section, as seen generally along line 12—12 of FIG. 10.

FIG. 13 is a downwardly looking section, as seen generally along line 13—13 of FIG. 10.

FIG. 14 is a downwardly looking section, as seen generally along line 14—4 of FIG. 10.

FIG. 15 is an enlarged detail, with parts broken away, as seen generally along line 15—15 of FIG. 10.

DESCRIPTION OF THE PREFERRED EMBODIMENTS

Figure 1:
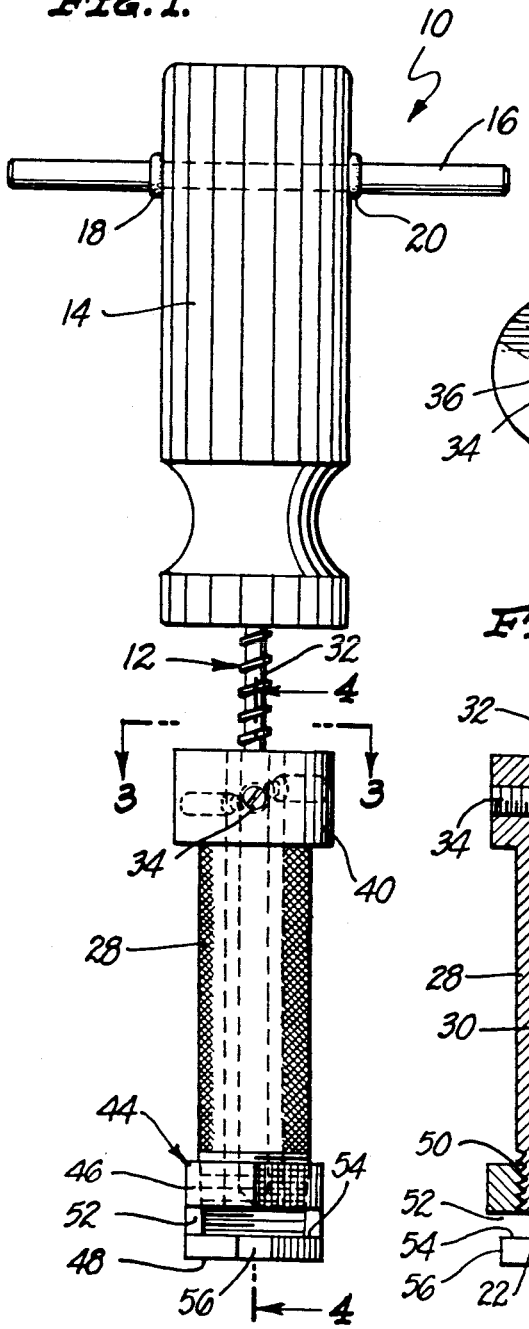
FIG. 1 is a side-elevational view of the first preferred embodiment of the screw-holding screwdriver of this invention.
Figure 5:
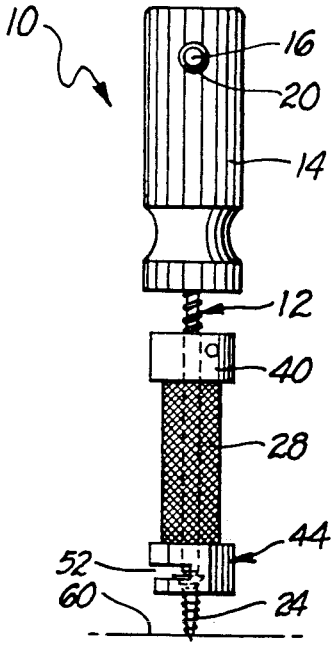
FIG. 5 is a side view of the screwdriver of FIG. 1, on a reduced scale, showing it holding a screw and the starting of the insertion of the screw into the substrate.
Figure 6:
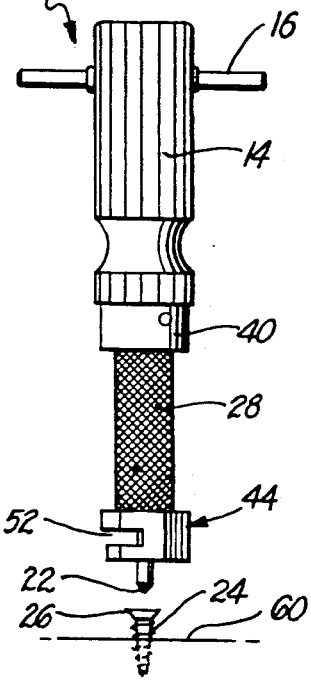
FIG. 6 is a view similar to FIG. 5, but showing the screw partially inserted and with the screwdriver detached and ready to drive the screw completely into position.

The first preferred embodiment of the screwholding screwdriver of this invention is generally indicated at 10 in FIGS. 1, 5 and 6. The screwdriver 10 has a shank 12 which defines the screwdriver axis. The screwdriver has a handgrip handle 14 which permits the user to rotate the screwdriver around its axis. While a handle o molded synthetic polymer composition material i: shown as being permanently molded to the shank 12 the handle is simply a drive means for rotating the shank. Thus, the drive means could be an attachmen means to a power driver or other convenient and conventional way for rotating the shank. Furthermore, the handle 14 could be of a different shape. In order tc increase the torque a user can apply, a cross handle 16 is provided. Cross handle 16 engages through a cross handle hole transverse to the axis. The cross handle is held in place by detents 18 and 20, which are conveniently resilient rings engaged in annular grooves in the cross handle just outside of the handle 14. Snap rings or rubber rings could be used to releasably retain the cross handle 16 in place.

Figure 4:
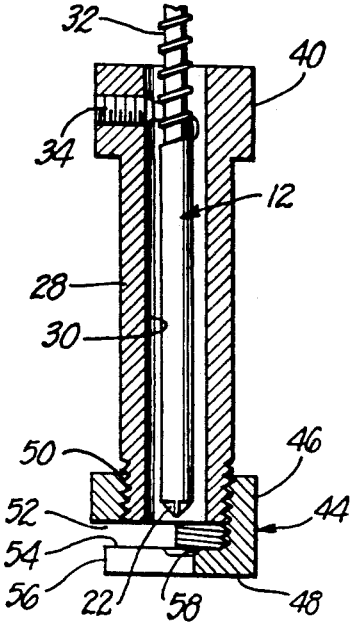
FIG. 4 is a longitudinal section through the screwdriver, with parts broken away, as seen generally along the line 4—4 of FIG. 1.

The forward or tip end of shank 12 has a bit 22, best seen in FIG. 4. The bit 22 is configured to engage upon the selected screw. The selected screw may have a Phillips recess, a cross slot, a square recess, a hexagonal recess, a star recess, or some other recess form. Furthermore, the head of the screw may be configured to have outwardly facing engagement surfaces such as a square or hexagonal head. The bit 22 is configured to engage the selected screw engagement surfaces. Furthermore, the bit at the tip of the shank may be removable and interchangeable. The removable bits insertable in this position may selectively have any one of the desired configurations. Thus, the desired bit is put in place with the bit configured to engage the selected screw. In the present case, screw 24 has a Phillips recess, and thus the bit 22 is a Phillips point. Most usually, the bit would be a Phillips point or a flat blade for engagement in a straight screw slot. It is to be noted that screw 24 has a head 26 which is of larger diameter than the screw shank. While a flathead screw is shown, the screwdriver 10 of this invention can be employed with any screw having a head.

Figure 3:
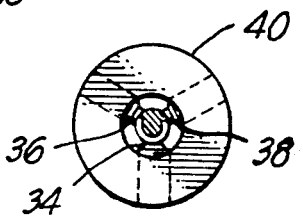
FIG. 3 is a downwardly looking section, as seen generally along the line 3—3 of FIG. 1.
Figure 8:
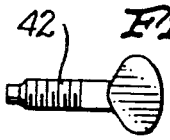
FIG. 8 is a side-elevational view of a dog-point thumb screw which can be employed to release the screw holder of this invention from its companion screwdriver.

The screw-holding portion of the screwdriver 10 includes sleeve 28. Sleeve 28 is tubular and has a central opening 30 therethrough which is large enough to receive shank 12 and permit axial and rotational movement of the sleeve with respect to the shank. In order to control the position of the sleeve 28 on shank 12, shank 12 is provided with screw threads 32. At least one pin is mounted in the sleeve and engages in the screw threads. In the preferred embodiment, the pin comprises three dog-point set screws 34, 36 and 38, seen in FIG. 3. These set screws are conveniently threaded into the sleeve to permit removal of the sleeve from the screwdriver shank. As is best seen in FIG. 4, collar 40 is provided at the top of the sleeve to make it thicker to properly support the set screws. Instead of three set screws, one can be employed providing the central opening 30 is not much larger than the diameter of shank 12. On the other hand, instead of a set screw which lies completely within its threaded hole, a thumb screw can be used. Thumb screw 42 is illustrated in FIG. 8, and three such thumb screws can be employed in place of the set screws 34–38 to permit the user to quickly remove and return the sleeve onto the shank. The advantage of set screws or thumb screws is that they can be released for quick motion of the sleeve along the shank and then reengaged. In this way, rapid adjustment is achieved. It is thus seen that, by rotation of the sleeve on the screwdriver shank, the sleeve also moves along the length of the shank. The sleeve is conveniently knurled or otherwise surfaced for comfortable grip to permit the user to rotate the sleeve with respect to the shank. The knurled sleeve 28 is sufficiently large that it can be grasped in order to also contribute to applying torque to the screw. The torque is contributed through the set screws or thumb screws, and, thus, three are preferred for strength by reason of this added torque. In addition, the added torque is applied through the chuck, frictionally to the under side of the screw head.

Figure 2:
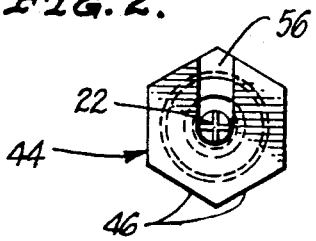
FIG. 2 is a bottom view thereof, showing the screw-holding chuck.

Chuck 44 is secured on the forward end of the sleeve, the lower end as seen in the drawings. In general, chuck 44 is a body of revolution about the upright axis. Chuck 44 is in the form of a cap having side walls 46 and front wall 48. Chuck 44 is detachably secured to the front of sleeve 28. Interengaging screw threads 50 are convenient attachment means. In the preferred embodiment, the chuck 44 is interchangeable so that different sizes can be employed, as is hereafter apparent. However, should it be desired that a particular screwdriver be dedicated to a particular small range of screw sizes, the chuck need not be removable. As is seen in FIG. 2, the exterior surface may have flats thereon for engagement by a wrench or other tool to aid in changing the chuck. Knurling would be an alternative surface finish for the chuck when it is removable.

The chuck 44 has two slots therein. Transverse slot 52 is slotted transverse to the axis and extends approximately to the axis, as is seen in FIGS. 4, 5 and 6. Transverse slot 52 defines screw-engaging surface 54. Screw slot 56 is defined by walls which are parallel to the axis. The screw slot extends to become a surface which is circular around the axis. The configuration is such that a screw may be inserted into the two slots so that it is positioned on the axis. Conical wall 58 is a surface of revolution around the axis and is of such angle as to receive a portion of the angular under-surface of a flathead screw. The slot with the screw slot 56 is such as to receive the shanks of a narrow range of screws so that the heads engage on the screw-engaging surface 54 or its adjacent conical wall 58. With the screwdriver shank high in the sleeve, a screw is placed sideways into the chuck with the head in slot 52 and shank in slot 56 until the screw is on the axis, as is shown in FIG. 5. Thereupon, the sleeve 28 is screwed up on the shank 12 so that the screwdriver bit 22 engages the head of the screw. When the user keeps the shank 12 screwed down into the sleeve, the screw is held firmly in place.

The screwdriver is then used for starting the screw in the configuration of FIG. 5. If no pilot hole is present, the screwdriver can be pounded on the end of its handle to begin a hole for the screw. Thereupon, the handle 14 is thrust toward the substrate 60 into which the screw 24 is being inserted. Forward axial thrust and rotation of the screwdriver around its axis drive the screw into the substrate. Forward torque, in the clockwise direction from the handle end of the screwdriver on the handle 14 rotates the screw in the insertion direction. At the same time, a slight resisting torque in the opposite direction applied to sleeve 28 keeps the screwdriver bit firmly into the head of the screw. Cross handle 26 may be employed to increase the insertion torque.

When the screw 24 is about half driven into the substrate 60, the chuck 44 must be released from the screw to permit the screw to be driven the whole way. This is accomplished by rotating the sleeve 28 on shank 12 in such a direction as to separate bit 22 from screw-engaging surface 54. This provides enough clearance that the chuck can be laterally removed off of the partially inserted screw. In this step, the screw shank and head pass out through the slots 56 and 52. The length of the screwdriver shank with respect to the sleeve is such that, when the shank is screwed all the way forward with the sleeve 28 against the bottom of handle 14, as seen in FIG. 6, the screwdriver bit 22 projects beyond the chuck 44 so that the screwdriver 10 can be used as a standard screwdriver with a free screwdriver tip to finish driving the screw 24.

Figure 7:
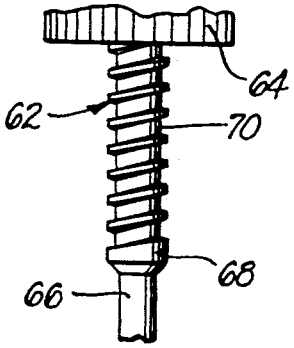
FIG. 7 is a side-elevational view of another embodiment of the screwdriver shank, with parts broken away.

For different sizes of screws or different screw ranges, different chucks 44 can be employed with wider or narrower screw slots 56 with a suitable width of slot 52 to receive the heads of those screws. In order to strengthen the screwdriver shank, instead of cutting threads 32 into the shank, the shank can be built up. In FIG. 7, screwdriver 62 has a handle or other driving means 64, a shank 66, and an enlarged shank portion 68. In the enlarged shank portion, threads 70 are cut so that their root diameter is approximately the same as shank diameter 66 to prevent weakening of the shank.

The second preferred embodiment of the screwholding screwdriver of this invention is generally indicated at 100 in FIGS. 9 and 10. The screwdriver 100 includes, as part of its shank 102, hexagonal drive shank 104. The hexagonal drive shank 104 is of standard size and can be driven by any conventional means, such as a power screwdriver or by manual driver 106. The manual driver has a handle 108 sized for manual grasp. It may have a crossbar such as crossbar 16, shown in FIG. 1, to aid in applying torque. Manual driver shank 110 is driven by the handle and has a socket 112 therein sized to receive and retain hexagonal drive shank 104. In this way, torque can be applied to hexagonal drive shank 104. As seen in FIG. 10, hexagonal drive shank 104 is permanently engaged in socket 114 in shank 102. Shank 102 is cylindrical in construction and has a right-handed screw thread 116 formed therearound. The screw thread is arcuate in configuration to receive the chord of a ball. The screw thread 116 terminates below top 118 of shank 102 and above the bottom 120 thereof.

The bottom of shank 102 carries hexagonal receptacle 122 therein. The hexagonal receptacle is sized to receive a standard screwdriver bit. A standard screwdriver bit 124 is illustrated as being removably seated in the receptacle 122. Conventionally, these bits have a groove 126 therein. In order to detachably retain the bit in its receptacle, ball 128 is urged by flat spring 130 into groove 126. Flat spring 130 is positioned in a shallow slot 130 located in the side of shank 102. The spring is held in place by crimping 134. In this way, the bit 124 is removable.

Sleeve 136 is in the shape of a cylindrical tube. Its outer surface 138 is knurled to aid in manual grasp of the sleeve. The sleeve has a cylindrical bore 140 which is sized to slide on shank 102. The sleeve has three ball bores 142, 144 and 146 spaced therearound. They are circularly spaced about 120 degrees apart and are axially spaced the same as the pitch of the screw thread 116. Three balls 148, 150 and 152 are respectively positioned in the ball bores. The balls are captured in the ball bores because the ball bores have a slightly smaller diameter than the ball at the inside surface of the sleeve, and the ball bores are staked at the outer surface of the sleeve. When in the inward position shown in FIGS. 10 and 12, the balls fully engage the screw thread 116.

The balls are held in the screw thread-engaged position by means of collar 154 which engages around the balls, see FIGS. 10 and 12. Collar 154 is a cylindrical tubular collar, preferably with a knurled exterior surface, as seen in FIG. 9. As seen in FIG. 9, a cylindrical collar 154 encircles sleeve 136 and is held thereon by being press-fitted to sleeve 136. Collar 154 is permanently attached thereon.

The lower end of sleeve 136 terminates in screw threads 164. Chuck 166 has corresponding screw threads and is removably threaded onto the lower end of sleeve 136. The chuck preferably has an outer diameter corresponding to the sleeve and is similarly knurled for appearance purposes, see FIG. 9. Chuck 166 is similar to chuck 44. It has a bore 168 therein which leaves a fairly thin face web 170 in the chuck. The face web is the surface which engages under the head of the screw. Since such screws are often flat-head screws, a tapered surface 172 is provided to engage under the tapered head of the screw. Since the chuck 166 is interchangeable, it may be provided with a flat surface at this location, that is, a web 170 of uniform thickness for use with screws having a flat underhead surface. Similarly, chucks of different sizes are provided for screws of different sizes.

In order to permit a screw to be placed into the chuck and against the surface 172, head slot 174 and shank slot 176 are provided. When the bit 124 is withdrawn into the dashed line position, as seen in FIG. 10, a screw may be placed into chuck 166. In this placement, the head passes through head slot 174, and the screw shank passes through shank slot 176. When in place, the sleeve is turned clockwise on the shank (looking down from the driving end toward the screw), and this causes the sleeve to move up the shank. This pulls the chuck upward and pulls the screw in the chuck to the tip of the bit 124. The tip of the bit is engaged in the screw slot. The screw is firmly held, and torque can be applied to the handle 106, sleeve 136 and collar 154. In this way, considerable torque can be applied.

It has been previously noted that the bit 124 can be readily removed. A bit of different size or different tip configuration can be employed, depending on the configuration of the drive surfaces in the screw head. If it is desired to use the screwdriver 100 without its capability for screw holding, such as for the final driving of a screw, the chuck is disengaged from the screw head and the sleeve is turned clockwise all the way to the end of the thread to the position shown in FIG. 10. In this position, the bit 124 extends beyond the face of the chuck for engagement with the screw head with interference.

Figure 16:
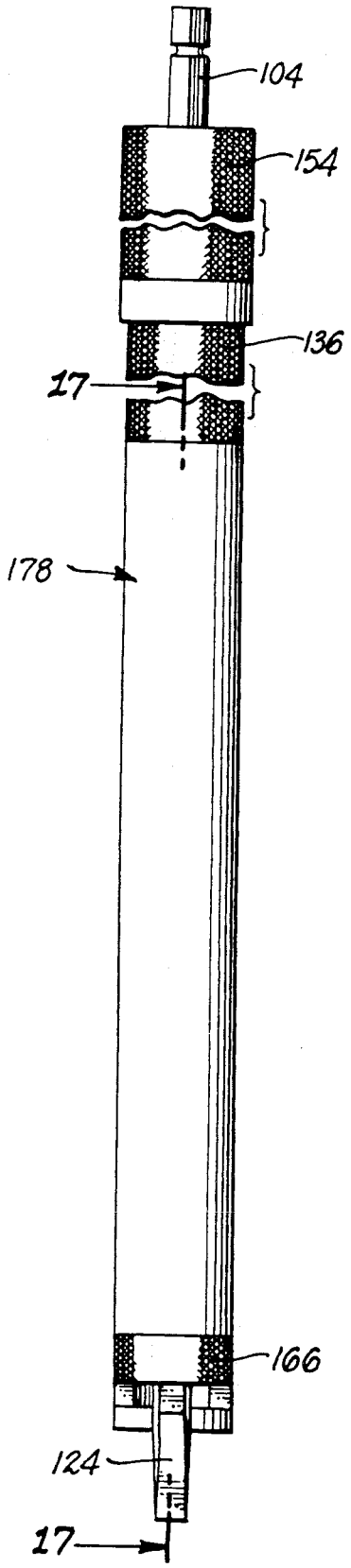
FIG. 16 is a side-elevational view, with parts broken away, of the screw-holding screwdriver of FIG. 9, and further including an extension therefor, with parts broken away.
Figure 17:
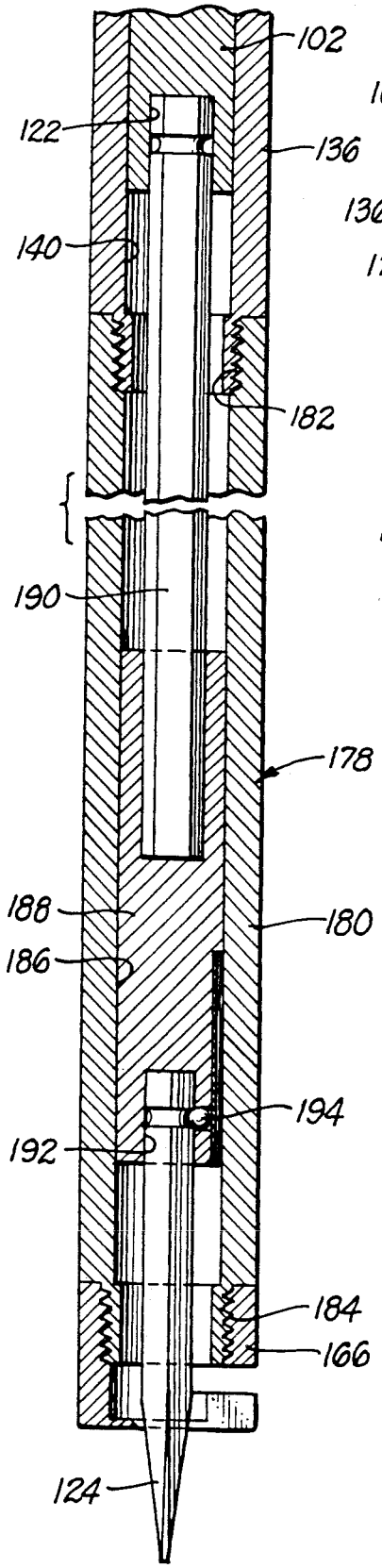
FIG. 17 is a longitudinal section, with parts broken away, as seen generally along line 17—17 of FIG. 16.

FIGS. 16 and 17 show extension 178. Extension 178 is configured to engage between and interact with shank 102 and sleeve 136 at the top and with chuck 166 at the bottom. Extension sleeve 180 has internal screw threads 182 which engage on the screw threads 164 on sleeve 136. At its lower end, the extension sleeve has external threads 184 which receive the threaded portion of chuck 166. Extension 178 has the same exterior diameter as sleeve 136 and may be conveniently knurled. Internally, extension 178 has a cylindrical bore 186 which is in line with bore 140. Extension shank 188 slides within bore 186. At its upper end, the extension shank 188 carries hexagonal drive shank 190 which engages in the hexagonal receptacle 122. Thus, the extension sleeve and extension shank have the same relative motions as the shank 102 and sleeve 138. At its lower end, extension shank 188 has hexagonal bit receptacle 192 which receives the bit 124. The bit is releasably retained by a detent ball 194, the same as detent ball 128. In this way, the bit 124 can operate with respect to chuck 166 in the same manner, but can be extended away from the driving end of the screwdriver, hexagonal drive shank 104.

Figure 18:
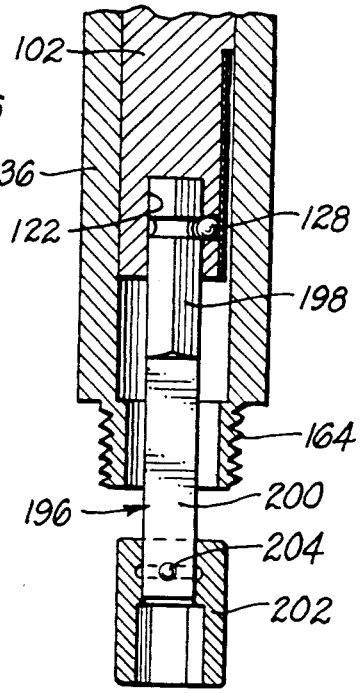
FIG. 18 is a section through the lower end of the screwdriver, as seen in FIG. 10, or the lower end of the extension, as seen in FIG. 17, showing a nut driver being driven thereby.

FIG. 18 shows adaptor bit 196. At its upper end, it is shown as being inserted into shank 102 with the sleeve 136 withdrawn and without a chuck. Adaptor bit 196 has a hexagonal upper section 198 which fits within the recess 122, previously described, and which is releasably retained therein by detent ball 128. Thus, the hexagonal section 198 is of standard configuration corresponding to the upper end of standard screwdriver bits. The lower end of adaptor bit 198 has thereon square section 200 which is sized to receive a standard square-drive wrench socket 202. The square section has a spring-loaded detent ball 204 therein for releasably retaining the square drive socket. The square section 200 can be $\frac{1}{4}$ inch square, $\frac{3}{8}$ inch square, or any other size or configuration which may be desired to drive a different kind of tool, such as socket 202. While the driving structure in the upper part of FIG. 18 is described as shank 102 and sleeve 136, it may just as well be extension shank 188 and extension sleeve 180 to, thus, provide extension to the socket. In this way, a screw-holding screwdriver is achieved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A screw-holding screwdriver comprising:

a shank having an axis;

drive means mounted on said shank for rotating said shank about its axis, screw threads on said shank adjacent said drive means;

a bit on the end of said shank opposite said drive means, said bit being configured to engage the head of a screw for rotating the screw;

a tubular sleeve mounted on said shank, three balls in said sleeve for engaging said screw threads for engaging said screw threads on said shank for providing axial movement of said sleeve with respect to said shank when said sleeve is rotated on said shank, said three balls being spaced around said sleeve, said sleeve having an upper end adjacent said drive means and a chuck end adjacent said bit, said sleeve having screw threads on the chuck end thereof;

a chuck detachably screwed onto said threads on said chuck end of said sleeve, said chuck having a front wall away from said drive means and a screw slot in said front wall, said slot having a width greater than the shank width of a screw to be driven by said screwdriver and narrower than the head of a screw to be driven by said screwdriver, a transverse slot in said chuck, said transverse slot intersecting said screw slot and being sufficiently large to receive the head of the screw to be driven by said screwdriver, both said slots extending to said axis, said transverse slot forming a screw-engaging surface facing said bit so that a screw may be inserted into said chuck and said drive means and said sleeve relatively rotated to axially move said sleeve on said shank so that said bit engages the screw in said chuck so that rotation of said drive means and said sleeve causes rotation of the screw.

2. The screw-holding screwdriver of claim 7 wherein a collar engages over at least a part of said sleeve and engages over said balls to hold said balls in said screw threads, said collar being movable with respect to said sleeve to release said balls from said screw threads to permit axial motion of said shank within said sleeve without relative rotation thereof.

3. The screw-holding screwdriver of claim 7 wherein said drive means is a manually engageable handle.

4. The screw-holding screwdriver of claim 3 wherein said handle has a cross handle therein for manually applying greater torque to said shank.

5. A screw-holding screwdriver comprising:

a screwdriver shank having an axis, said shank having a bit end and a driving end;

drive means on said driving end of said shank for rotating said shank about its axis, screw threads on said shank adjacent said handle;

a screwdriver bit on said bit end of said shank configured for engagement with the head of a screw to rotate the screw;

a sleeve axially movable on said shank, three balls angularly arranged around said sleeve for engagement in threads on said shank;

a chuck threadedly mounted on said sleeve for interchangeability, said chuck having a screw slot therein wider than the shank and narrower than the head of a screw to be driven by said screwdriver and said chuck having a side slot therein to pass the head of the screw so that the screw may be positioned on said axis, said sleeve having a manual gripping surface thereon so that said drive means can be held and said sleeve can be grasped and relatively rotated so that said sleeve is moved up said shank toward said driving end of said shank to engage a screw between said bit and said conical surface to hold the screw against said screwdriver bit to retain the screw for driving.

6. The screw-holding screwdriver of claim 5 wherein said three balls are retained in engagement with said threads on said shank by means of a collar engaging around said sleeve and around said balls, said collar being movable away from said balls to release said balls from thread engagement to permit rapid axial relative motion between said sleeve and said shank.

7. The screw-holding screwdriver of claim 5 wherein said screw slot has a conical surface about said axis for engagement by a conical screwhead surface.

8. A screw-holding screwdriver comprising:

a shank having an axis;

a drive end on said shank for rotating said shank about its axis, screw threads on said shank adjacent said drive end;

a bit on the end of said extension shank opposite said drive end, said bit being configured to engage the head of a screw for rotating the screw;

a tubular sleeve mounted on said shank, three balls in said sleeve angularly arranged around said sleeve for releasably engaging said screw threads on said shank for providing axial movement of said sleeve with respect to said shank when said sleeve is rotated on said shank, said sleeve having a drive end and a chuck end adjacent said bit, said sleeve having a manually engageable surface thereon;

a chuck on said chuck end of said extension sleeve, said chuck a front wall away from drive end handle and a screw slot in said front wall, said slot having a width greater than the shank width of a screw to be driven by said screwdriver and narrower than the head of a screw to be driven by said screwdriver, a transverse slot in said chuck, said transverse slot intersecting said screw slot and being sufficiently large to receive the head of the screw to be driven by said screwdriver, both said slots extending to said axis, said transverse slot forming a screw-engaging surface facing said bit so that a screw may be inserted into said chuck and said drive and rotated and said sleeve manually grasped and relatively rotated to axially move said sleeve on said shank so that said bit engages the screw in said chuck so that grasp on and rotation of said handle and said sleeve causes rotation of the screw.

9. The screw-holding screwdriver of claim 8 wherein said three balls are retained in engagement with said threads on said shank by means of a collar engaging around said sleeve and around said balls, said collar being movable away from said balls to release said balls from thread engagement to permit rapid axial relative motion between said sleeve and said shank.

10. The screw-holding screwdriver of claim 8 wherein said sleeve has screw threads on the chuck end thereof and said chuck is detachably screwed onto said screw threads on said sleeve.

11. A screw-holding screwdriver comprising:

a shank having an axis;

a drive end on said shank for rotating said shank about its axis, screw threads on said shank adjacent said drive end; an extension shank mounted on said shank opposite said drive end;

a bit on the end of said extension shank opposite said drive end;

a tubular sleeve mounted on said shank, at least one thread engagement means in said tubular sleeve for releasably engaging said screw threads on said shank for providing axial movement of said sleeve with respect to said shank when said sleeve is rotated on said shank, said sleeve having a drive end and a chuck end adjacent said bit, said sleeve having a manually engageable surface thereon;

an extension sleeve attached to said chuck end of said sleeve, said extension sleeve having a chuck end;

a chuck on said chuck end of said extension sleeve, said chuck having a front wall away from drive end handle and a screw slot in said front wall, said slot having a width greater than the shank width of a screw to be driven by said screwdriver and narrower than the head of a screw to be driven by said screwdriver, a transverse slot in said chuck, said transverse slot intersecting said screw slot and being sufficiently large to receive the head of the screw to be driven by said screwdriver, both said slots extending to said axis, said transverse slot forming a screw-engaging surface facing said bit so that a screw may be inserted into said chuck and said drive and rotated and said sleeve manually grasped and relatively rotated to axially move said sleeve on said shank so that said bit engages the screw in said chuck so that grasp on and rotation of said handle and said sleeve causes rotation of the screw.

12. The screw-holding screwdriver of claim 11 wherein said extension comprises an extension sleeve attached to said tubular sleeve and said chuck being mounted on said extension sleeve and further including an extension shank attached to said bit end of said shank and a bit in said shank adjacent said chuck.

13. The screw-holding screwdriver of claim 12 wherein said bit is configured to engage the drive opening in a socket for rotating the socket.

* * * * *